US005421740A

United States Patent [19]

Dittburner et al.

[11] Patent Number: 5,421,740

[45] Date of Patent: Jun. 6, 1995

[54] ELECTRONIC CIRCUIT PACK AND MOUNTING FRAME COMBINATION

[75] Inventors: Robert C. Dittburner, Ontario; Joseph J. Lommen, Nepean; Adrianus P. Van Gaal, Kanata; Nicholas J. Pitt, Nepean; Colin D. Smith, Ottawa; Michael J. Coleman, Woodlawn, all of Canada

[73] Assignee: Northern Telecom Limited, Montreal, Canada

[21] Appl. No.: 160,631

[22] Filed: Dec. 2, 1993

[51] Int. Cl.[6] ..... H01R 13/629

[52] U.S. Cl. ..... 439/376

[58] Field of Search ..... 439/376–378

[56] References Cited

U.S. PATENT DOCUMENTS 5,035,627 7/1991 Burnett et al. ..... 439/377

*Primary Examiner*—Gary F. Paumen

*Attorney, Agent, or Firm*—R. J. Austin

[57] ABSTRACT

Electronic circuit pack and mounting frame combination in which a mating connector joined to conductors coming in for connection to the circuit pack, is held within a connector holder for protection and connection purposes. Straight line action of the connector holder is ensured to ensure proper alignment of the mating connector with the circuit pack connector. It is preferable for the connector holder to be permanently attached to the frame to support the weight of the holder and minimize strain upon the incoming conductors.

11 Claims, 6 Drawing Sheets

ELECTRONIC CIRCUIT PACK AND MOUNTING FRAME COMBINATION

This invention relates to electronic circuit pack and mounting frame combinations.

Electronic circuit packs are known which are receivable into receiving stations in shelves or frames of telecommunications or other electronic equipment. These packs are normally connected by connectors at the rears of the shelves to back planes. At the front ends of the circuit packs, it is not uncommon for connectors also to be provided for connection by mating connectors to signal conductors extending to other circuit packs in the same frame or to other items of equipment exteriorly of the frame. In such cases, where there is more than one mating connector mounted on signal conductors for connection to a connector or connectors at the front end of a particular circuit pack, there is sometimes a problem in avoiding confusion as to mating connection positions during initial installation or during maintenance or repair. Furthermore, the mating connectors for connection to the front ends of the circuit packs are vulnerable to damage either during use or during maintenance as in the latter circumstance, mating connectors tend to be left hanging loosely on their associated conductors.

The present invention seeks to minimize or avoid the above problems.

Accordingly, the present invention provides an electronic circuit pack and mounting frame combination comprising: a circuit pack having a front end with at least one telecommunications connector located at the front end; a mounting frame having a receiving station opening at a front of the frame for receiving the circuit pack into the front of the frame with the front end of the circuit pack at the front of the frame; a mating connector for mating with the circuit pack connector, a connector holder carrying the mating connector; and means to control movement of the connector holder and to ensure straight line action of the mating connector when connecting it to and disconnecting it from the circuit pack connector.

With combinations according to the invention, with the electronic circuit pack disposed in its receiving station the mating connector is protected in use by the connector holder. In addition, this protection also applies when the connector holder is moved to the withdrawn position in which the connector holder would normally extend outwardly from the front of the frame. Furthermore, in a situation where two or more mounting connectors are to be used with a circuit pack, then these mating connectors are assembled onto the connector holder in their appropriate relative locations and maintain these locations during connecting them to and disconnecting them from the circuit pack whereby no confusion may arise as to their connection positions upon the circuit pack. In constructions according to the invention, the mating connector and the connector holder may hang freely from the conductors which are connected to the mating connector, in cases where the conductors are sufficiently robust to carry the weight. Alternatively, the connector holder is controlled in position by attachment to the frame. The attachment to the frame permits movement of the connector holder between a closed position in which the mating connector is mated with the circuit pack connector when the circuit pack is in the receiving station, and a withdrawn position with the connectors disconnected from one another, to permit freedom of movement of the circuit pack into and out from the receiving station. Hence, in the alternative case, the weight of the mating connector is not taken upon the conductors when the mating connector is in the withdrawn position thereby avoiding resultant damage to the connection between connector and conductor. For this purpose, it is preferable for the connector holder to extend forwardly of the mating connector when in the mating position and is provided with control means for controlling the positions of signal conductors extending to the mating connector.

In one arrangement, the connector holder is pivotally connected to the frame to permit movement of the connector holder into and out of the withdrawn position. For this purpose the connector holder may be pivotally connected to the frame by being mounted upon an elongate member which is slidable in the slot extending in a forward to rearward direction of the frame. Means to control movement of the connector to ensure its straight line action may be provided by a coacting projection and projection receiving guide channel provided one upon the frame and the other upon the connector holder, the guide channel extending parallel to the slot to control the connector holder movement towards the end of its travel into the mating position for the purpose of alignment of the terminals of the two connectors. Preferably, however, the means for ensuring straight line action of the mating connector for alignment purposes comprises cooperable alignment elements provided upon the circuit pack connector and upon the mating connector. These alignment elements engage each other for terminal alignment before the connection between the terminals is actually made.

In another arrangement, the connector holder is attached to the frame in some other fashion, e.g. by a flexible cable or linkage which relieves strain upon conductors extending to the mating connector.

It is also preferable that a latching means is provided and which is operable to detachably retain the connector holder in the closed position. Conveniently, the etching means may be a cam latching means which is operable by camming action to move the connector holder into its closed position and while the connectors are being interconnected. The cam latching means may also lever the holder out of the closed position and into the open position.

Embodiments of the invention will now be described by way of example, with reference to the accompanying drawings, in which.

Figure 1:
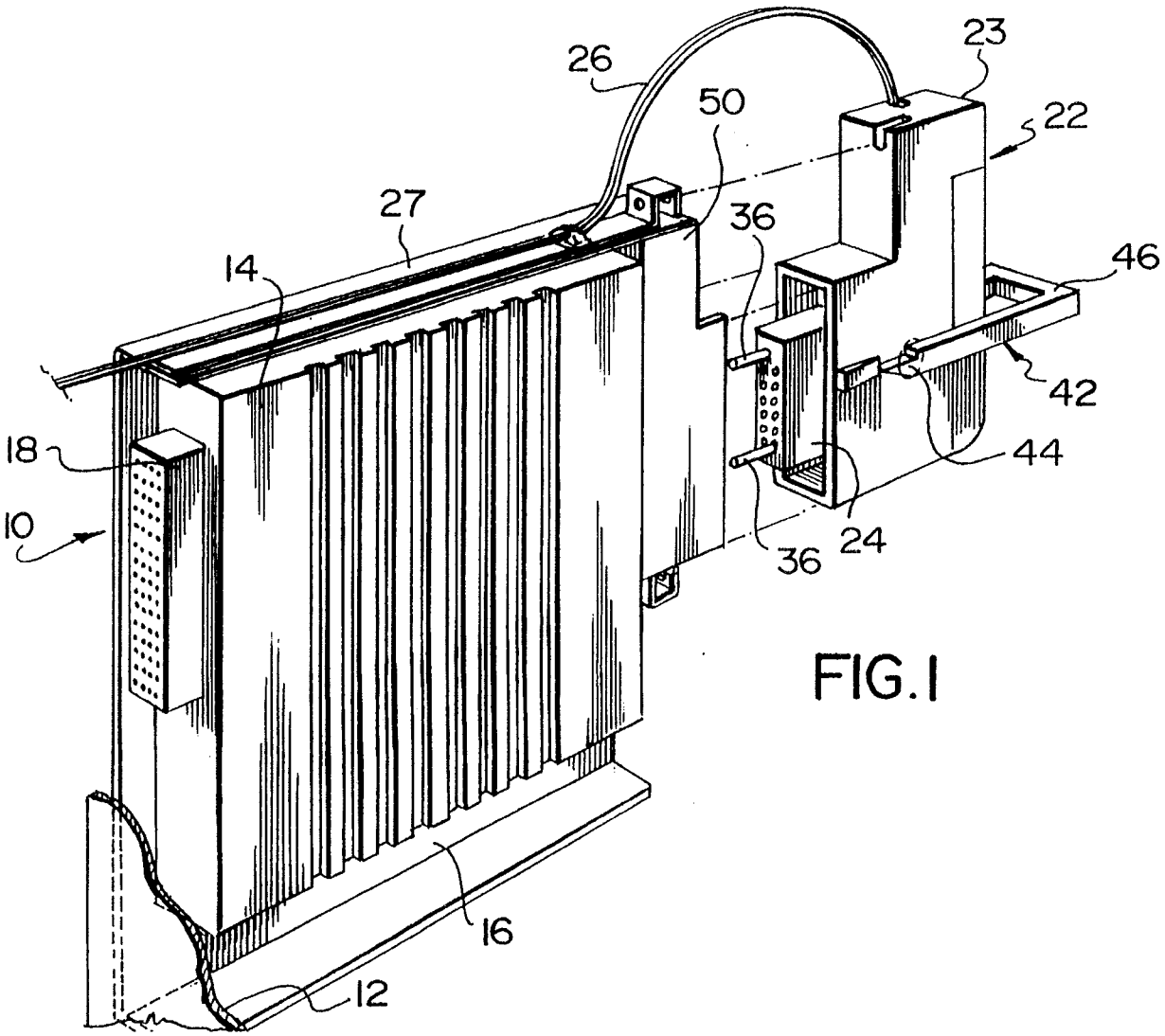
FIG. 1 is an exploded isometric view of a combination of an electronic circuit pack mounted in a shelf and having an associated connector holder.

In a first embodiment as shown in FIG. 1, in an electronic circuit pack and mounting frame combination, the mounting frame comprises a shelf 10 for receiving electronic circuit packs 14 (one only being shown) through a front of the shelf into a plurality of side-by-side receiving stations 16 of the shelf. The shelf has a rear in which a back plane 12 is provided in conventional fashion. As shown in FIG. 1 the circuit pack 14 comprises a connector 18 at its rear end for connection into a mating connector (not shown) in the back plane 12 in conventional manner. At the front end of the circuit pack 12 there is provided a forwardly facing connector 20 (FIGS. 2 and 3) having terminals (not shown).

Figure 2:
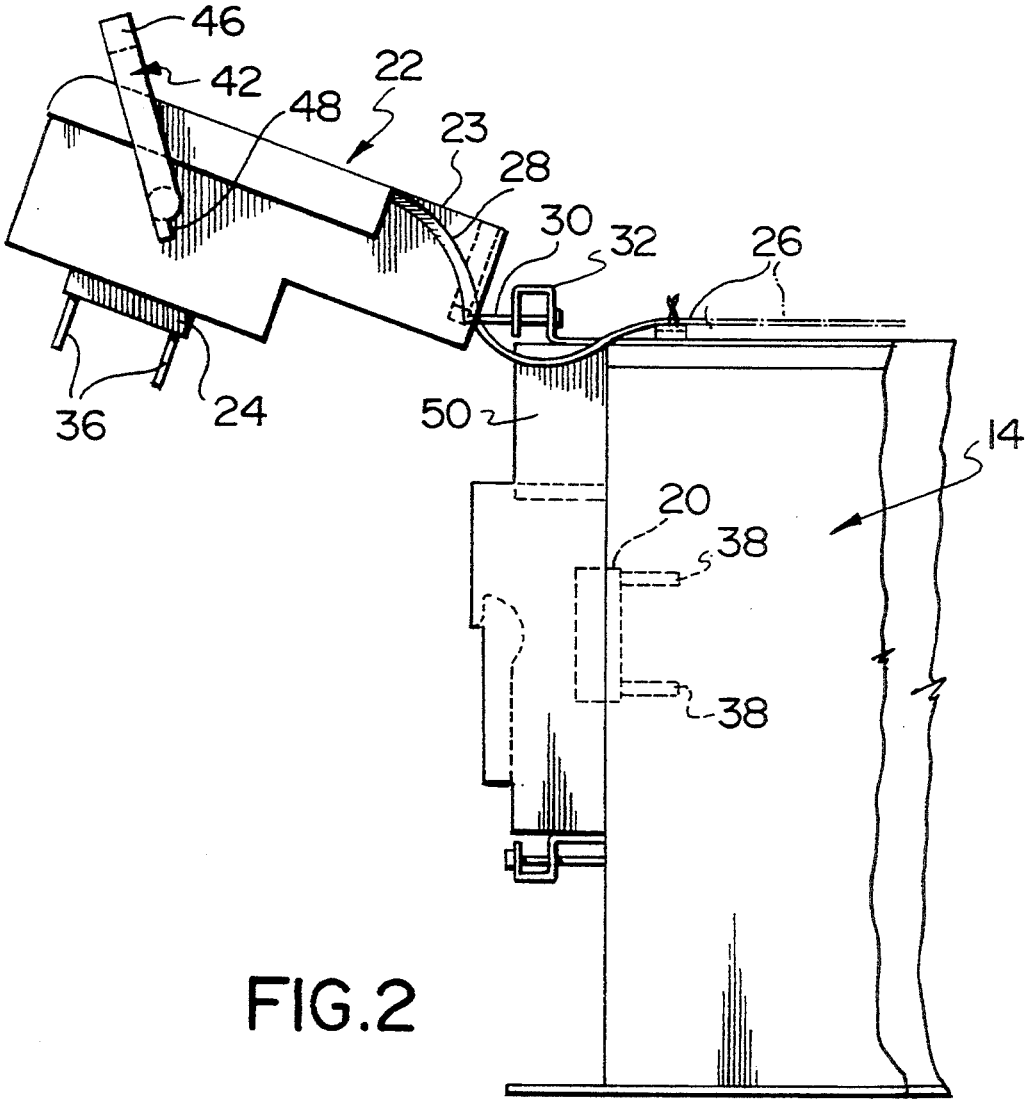
FIG. 2 is a side elevational view of the combination and shows the connector holder in a withdrawn position to allow for movement of the circuit pack into and out of a receiving station in the shelf.
Figure 7:
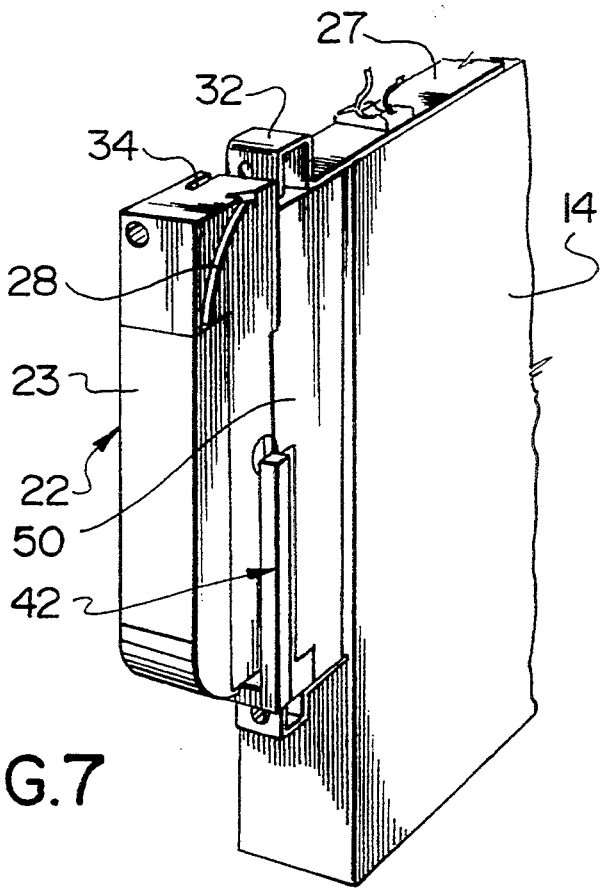
FIG. 7 is an isometric view taken from the front and showing the connector holder in the closed position.
Figure 3:
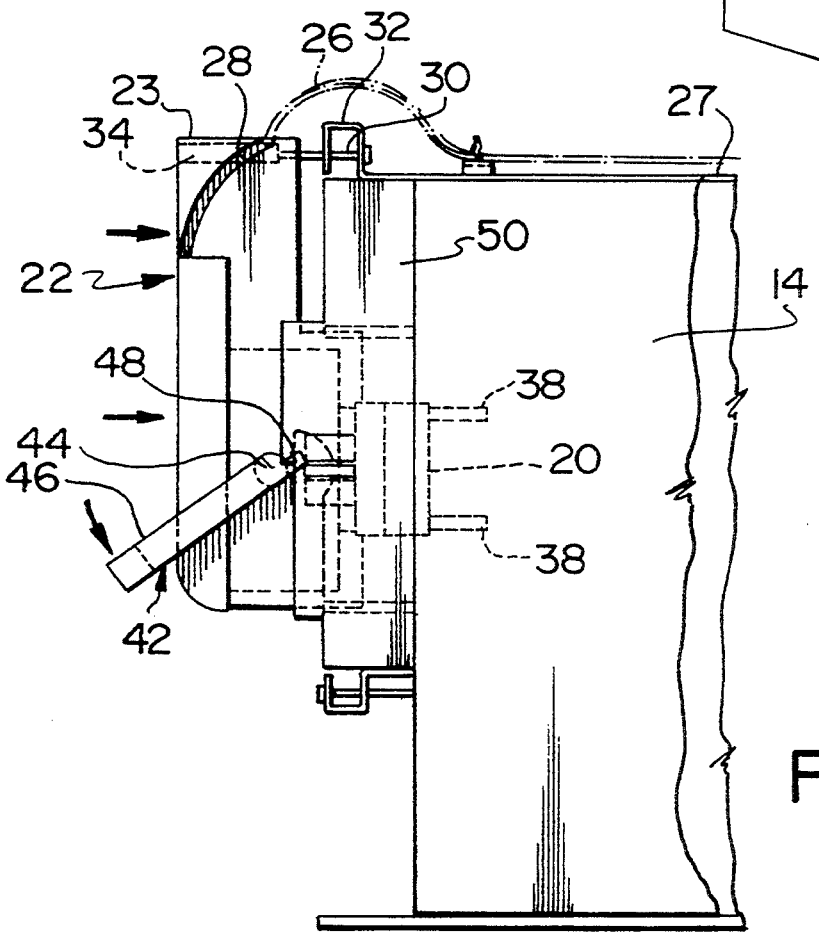
FIG. 3 is a view similar to FIG. 2 and showing movement of the connector holder towards a closed position.

The combination also comprises a connector holder 22 carrying a mating connector 24 for mating with the connector 20 at the front end of the circuit pack. As shown in FIGS. 1, 2 and 3, the connector holder 22 provides a housing 23 of a width no greater than the width of the circuit pack 14, the housing enshrouding a part of the mating connector 24 and also enshrouding terminal end portions of signal conductors 26 which extend to the connector 24. The conductors 26 extend from a rear of the frame and are held in position onto a flange 27 forming a top of the receiving station, the conductors then issuing from the front of the frame and passing into a guidance slot 28 in the housing 23 before continuing into the inside of the housing and to the terminals of the connector 24. The connector holder 22 is attached to the frame at the top of the receiving station by a pin 30 slidably received for longitudinal front and rear movement of the shelf within a bracket 32 on the shelf. The forward end of the pin is received within the connector holder with the shaft of the bolt passing through a slot 34 which extends from a rear to a top surface of the housing 23 (FIGS. 1, 2 and 7). This allows for movement of the connector holder in a front or rear direction of the shelf and also provides for a pivoting movement of the holder to allow for withdrawal of the connector holder to a withdrawn position (FIG. 2) as will be described.

Figure 6:
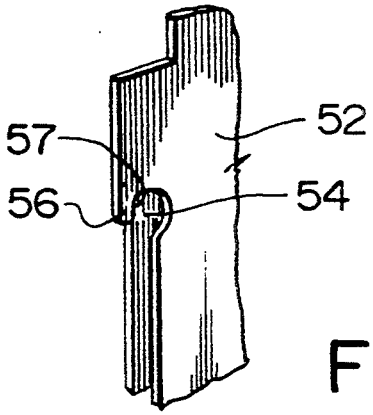
FIG. 6 is an isometric view of part of the front end of the circuit pack to show a cam used in the cam latching action.

The connector holder is also movable into a closed position (see FIG. 6) in which the mating connector 24 is connected to the connector 20 of the circuit pack 14. Means is provided to control movement of the connector holder to ensure straight line action of the mating connector when connecting it to and disconnecting from the circuit pack connector. This means is provided by alignment elements provided upon the two connectors themselves. In this embodiment these alignment elements are provided by alignment pins 36 disposed one at each end of the connector 24 and complementary pin receiving bores formed by extensions 38 of the connector 20 extending from end regions of the connector 20 rearwardly of the circuit pack 14.

Figure 4:
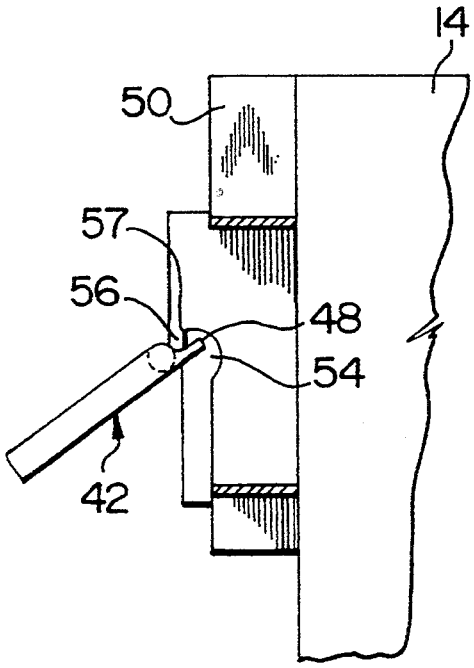
FIG. 4 is a view similar to FIG. 3 with parts removed to show a cam latching action during movement of the connector holder into the closed position.

In addition to this, the structure is provided with latching means which are operable during movement of the connector holder into the closed position upon a circuit pack. This latching means comprises a U-shaped latching arm 42 which straddles the housing 23 and the two free ends of which are pivoted at positions 44 at each side of the housing. This provides a long outwardly extending lever 46 for manual operation. At each free end the latching arm is provided with a latch 48 which operates as a cam latch. As shown in greater detail in FIGS. 4, 5 and 6, together with FIG. 1, the front end of the circuit pack is provided with a rectangular shroud 50 for receiving the rearward end of the connector holder.22 when this is moved into the closed position. The shroud 50 has on opposing inner surfaces 52, two recesses 54 which open forwardly, each for receiving a latch 48. At a forward upper end of each recess 54 a latch retaining element 56 of tapering construction extends downwards. The rear facing surface 57 of the element 56 serves as a cam which cooperates with the latch 48. The latch 48 is so shaped that upon its rotation in an anticlockwise direction as shown in FIG. 4 with it received within the recess 54, it engages the rear surface 57 of the projection 56 and, during anticlockwise movement, effectively draws the connector holder 22 into its closed position to mate the two connectors.

Figure 5:
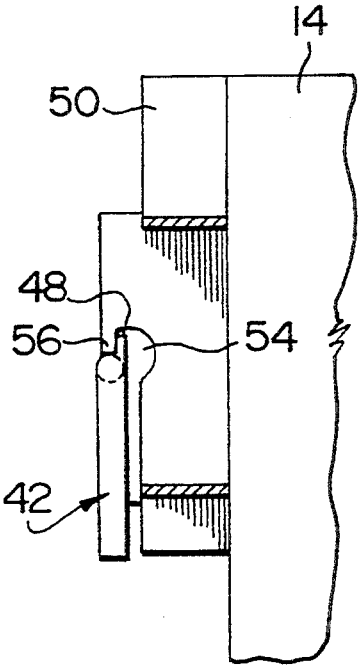
FIG. 5 is a view similar to FIG. 4 showing the cam latching action with the connector holder in the closed position.

In use, as may be seen from FIG. 2, to insert the circuit pack, the connector holder 22 is moved about the pin 30 to a withdrawn position. The pack 14 is then inserted into its receiving station and once in position, the connector holder is pivoted downwardly to make a connection with the connector 20. Towards the end of the movement from the withdrawn position towards the closed position, the connector holder is first approximately aligned manually with the circuit pack by insertion of the connector holder into the rectangular shroud 50. As the connector holder is urged towards the circuit pack, the alignment pins 36 become located within the bores of extensions 38 so as to align the two connectors 24, 20 accurately as rearward movement of the connector holder continues. With the lever 46 raised above the position shown in FIG. 3, each latch 48 becomes inserted into its recess 54 and then by downward movement of the lever is moved manually anticlockwise so that the latch 48 acts upon the cam surface 57 at the rear of the projection 56. This effectively draws the connector holder into the fully closed position in which the two connectors are mated together and the connector holder is held securely. In this position the latch member 42 extending vertically downwards from its pivot as shown in FIGS. 5 and 7. To remove the mating connector 22, it is simply necessary to rotate the lever 46 in a clockwise direction so as to lift it from the FIG. 7 position beyond the FIG. 3 position to release the latch 48 from behind the projection 56. The connector holder 22 may then be drawn forwardly and returned to its withdrawn position shown in FIG. 2 for circuit pack removal.

As may be seen from the above embodiment, the connector holder completely protects both the mating connector 24 and the connector 20 in the circuit pack during use. Further to this, the connector holder at least partially protects the mating connector when the connector holder is in the withdrawn position as shown in FIG. 2. Apart from this, as may be seen from the disclosure, the weight of the mating connector 24 is not supported by the signal conductors 26 when removed from the circuits pack so that the connection between the conductors and the mating connector does not suffer. Any damage is avoided by having both the mating connector and the conductors held securely by the connector holder which holds them in their relative positions. One further advantage is that the provision of the connector holder 22 mounted upon the frame conveniently enables the conductors 26 to be positioned within the frame in such a way as to be led away from the front of the frame while being easily connected into the connector holder 22 and to the mating connector 24. This thus avoids the unsightly appearance of the conductors at the front of the frame together with any potential accidental damage.

Figure 8:
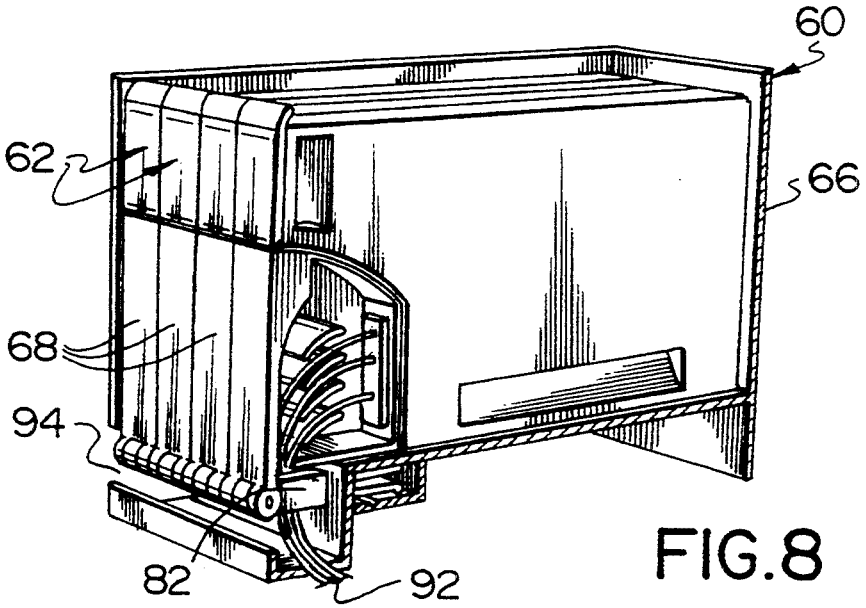
FIG. 8 is a front isometric view showing a plurality of electronic pack and mounting frame combinations according to a second embodiment.

In a second embodiment as shown in FIG. 8, a frame comprises a shelf 60 (shown only in part) in which are disposed a plurality of detachable electronic circuit packs 62 received in side-by-side receiving stations. Each circuit pack 62 in its receiving station is connected by a connector 64 into a back plane 66 in conventional manner.

Each circuit pack 62 is provided with its own connector holder 68 for carrying a mating connector 70 of a forward facing connector 72 passing forwardly from a front edge region of the pack 62.

Figure 11:
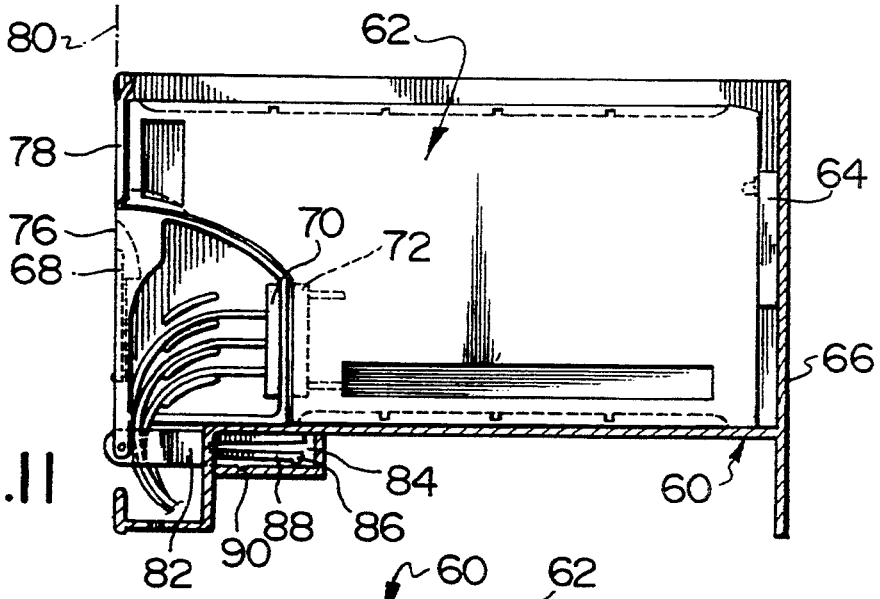
FIG. 11 is a view similar to FIG. 9 and showing the connector holder in the fully closed position.

The connector holder 68 is received in a closed position in a lower front recess 74 of the circuit pack 62 and in this position a forward edge 76 of the connector holder lies substantially in alignment with a forward edge 78 of the circuit pack 62 which is also substantially coincident with the front edge 80 of the shelf as shown by chain-dotted outline in FIG. 11. Hence, when in the closed position not only are the connectors 70 and 72 completely protected, but also the connector holder itself is also protected from any activity taking place outwardly from the front of the shelf.

Figure 10:
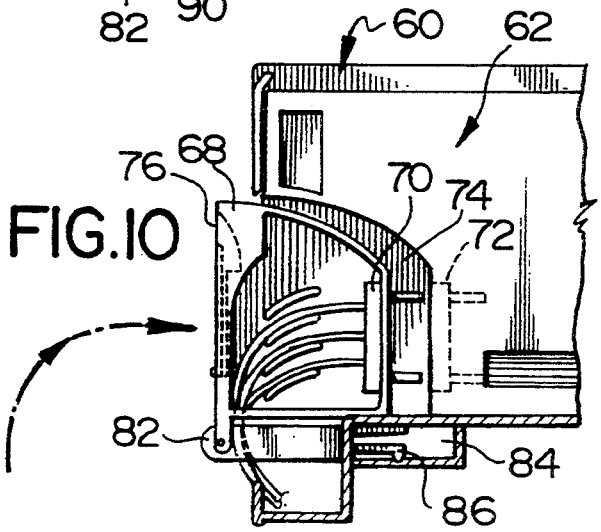
FIG. 10 is a view similar to FIG. 9 showing the connector holder as it is being moved into a closed position upon the circuit pack.

The connector holder 68 is pivotally connected to the shelf at a corner which lies at the lower front of the holder in the closed position, to an elongate member in the form of a pin 82 of rectangular cross-section. This pin is movable in a slot 84 in the shelf for longitudinal movement, i.e. in a forward and rearward direction of the shelf. The pin 82 is movable between the rear position shown in FIG. 11 within the shelf and a forward position shown in FIG. 10 in which a projection.86 at a rear end of a flexible leg 88 of the pin engages within a corresponding projection receiving recess 90 in the structure of the shelf.

Figure 9:
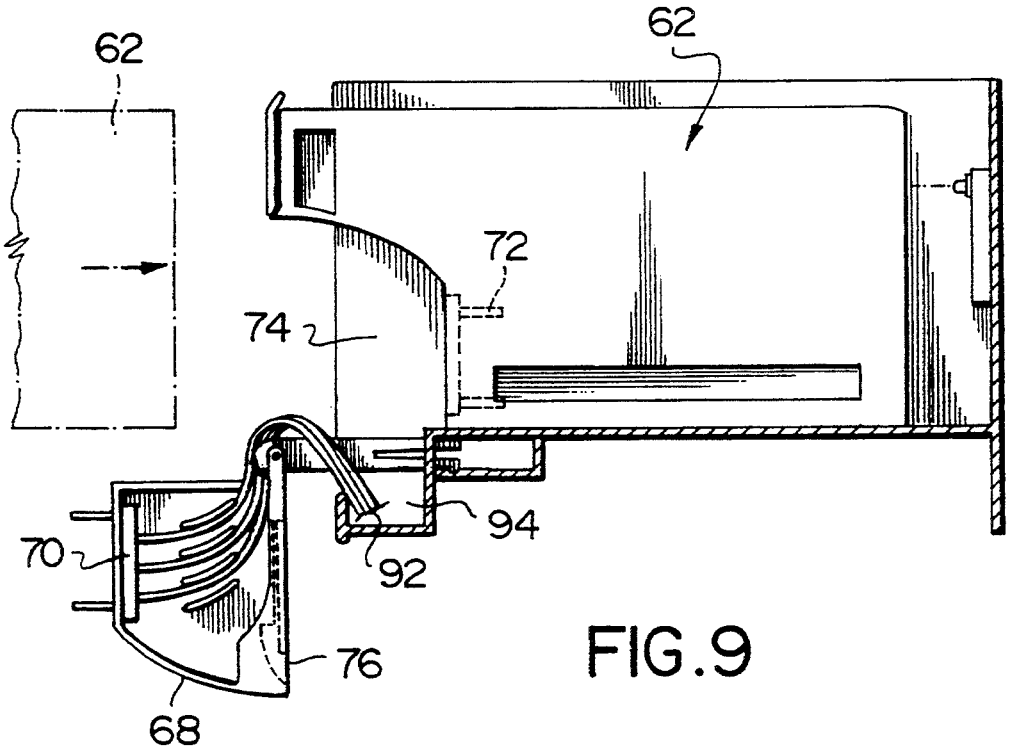
FIG. 9 is a side elevational view of one combination and showing the connector holder in a withdrawn position.

In use, to insert the circuit pack 62 into its receiving station, the connector holder 68 is moved into its withdrawn position. In this position the pin 82 is forwardly as shown in FIG. 9 and the connector holder 68 extends downwardly away from the path of movement of the circuit pack. Signal conductors 92 extend from the connector 70 through a guide channel 94 and laterally across the front of the shelf, as shown particularly in FIG. 8, and thence along a side of the frame which forms the shelves. After insertion of the circuit pack 62 from its chain dotted position, through the full outline intermediate position in FIG. 9, and into the final position in FIGS. 10 and 11, the connector holder is then pivoted upwards so that it moves into the recess 74 in the circuit pack through the position shown in FIG. 10 and into the FIG. 11 position. As may be seen, upon reaching the position of FIG. 10, the connector holder engages the bottom of the shelf and then is moved rearwardly by movement of the pin 82 towards its rearward position shown in FIG. 11. This carries the connector holder into its closed position with no further pivotal movement and in doing so the connectors 70 and 72 become aligned so as to provide for the straight line action required for connection and disconnection of the two connectors. In fact, the connectors 70 and 72 may be similar in construction to the connectors 20 and 24 in the first embodiment whereby the means to control the straight line movement is in fact provided by these two connectors.

In the finished assembly, there is no tendency for the connector holder to move out from its closed position because of the interengagement of the two connectors 70 and 72. As discussed above, not only are the two connectors protected from the outside environment but also the connector holder 68 itself is protected with only a front face showing from the front of the shelf. The connector holder also provides the advantages discussed above with regard to the first embodiment.

For removal of the circuit pack 62, the connector holder 68 is withdrawn by forward movement to disconnect the connectors 70 and 72 whereby it may then be pivoted downwardly to the position shown in FIG. 9 out of the path of the forward movement of the circuit pack.

What is claimed is:

1. An electronic circuit pack and mounting frame combination comprising:

a circuit pack having a front end with at least one telecommunications connector located at the front end;

a mounting frame having a receiving station with an opening at a front of the frame for receiving the circuit pack into the front of the frame with the front end of the circuit pack at the front of the frame;

a mating connector for mating with the circuit pack connector, and a connector holder carrying the mating connector;

and means to control movement of the connector holder and to ensure straight line action of the mating connector when connecting it to and disconnecting it from the circuit pack connector;

the connector holder being pivotally mounted to the frame to permit movement of the connector holder between a closed position in which the mating connector is mated with the circuit pack connector when the circuit pack is in the receiving station, and a withdrawn position with the connectors disconnected from one another, the withdrawn position permitting freedom of movement Of the circuit pack into and out from the receiving station.

2. A combination according to claim 1 wherein the circuit pack connector and the mating connector have cooperable alignment elements to align terminals of the connectors before connection of the terminals, the alignment elements providing the means to ensure straight line action of the mating connector.

3. A combination according to claim 2 provided with latching means operable to retain the connector holder in the closed position.

4. A combination according to claim 3 wherein the latching means is a cam latching means operable to control movement of the connector holder into the closed position and during interconnection of the connectors.

5. A combination according to claim 1 wherein the connector holder extends forwardly of the mating connector when in the mating position and controls the positions of signal conductors extending to the mating connector.

6. A combination according to claim 4 wherein the cam latching means comprises a manually operable lever provided upon the connector holder, the lever having a latch having one end engageable with a cam surface at the front of the circuit pack to control movement of the connector holder into a closed position during pivoting of the lever in one direction, and in the closed position the mating connector is mated with the circuit pack connector when the circuit pack is in the receiving station.

7. A combination according to claim 6 wherein the front of the circuit pack provides a shroud for surrounding a part of the connector holder, the cam surface formed on an inside surface of the shroud, and the latch is locatable within the shroud to engage it with the cam surface.

8. A combination according to claim 1 wherein the connector holder is pivotally mounted to the frame by an elongate member slidably movable in a forward and rearward direction of the frame, the elongate member being in a forward position with the pivotal axis of the connecting member disposed forwardly of the front of the frame in the withdrawn position of the connector holder, and in a rearward position with the connector holder in the closed position.

9. A combination according to claim 8 wherein with the connector holder in the closed position, the circuit pack connector and the mating connector are disposed rearwardly of the front of the frame.

10. A combination according to claim 1 wherein the means to control movement of the connector holder to ensure straight line action of the mating connector comprises guide means to ensure straight line action of the connector holder relative to the frame.

11. A combination according to claim 1 wherein the connector holder is pivotally connected to the frame by a pin which is slidably mounted in a slot extending in a forward and rearward direction and the means to control straight line movement of the mating connector comprises a guide means comprising a coacting projection and projection receiving guide channel provided one upon the frame and the other upon the connector holder, the guide channel extending parallel to the slot to control the connector holder movement towards the end of its travel into the closed position.

* * * * *